US010764666B1

(12) United States Patent
Napoles et al.

(10) Patent No.: US 10,764,666 B1
(45) Date of Patent: Sep. 1, 2020

(54) CAPACITANCE LOADED ANTENNA FOR EAR-WORN ELECTRONIC DEVICE

(71) Applicant: Amazon Technologies, Inc., Seattle, WA (US)

(72) Inventors: Adrian Napoles, Gilroy, CA (US); Balamurugan Shanmugam, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/102,401

(22) Filed: Aug. 13, 2018

(51) Int. Cl.

| | |
|---|---|
| ***H04R 1/10*** | (2006.01) |
| ***H01Q 1/27*** | (2006.01) |
| ***H01Q 7/00*** | (2006.01) |
| *H04R 5/033* | (2006.01) |

(52) U.S. Cl.
CPC ..... *H04R 1/1016* (2013.01); *H01Q 1/273* (2013.01); *H01Q 7/005* (2013.01); *H04R 1/1058* (2013.01); *H04R 5/0335* (2013.01); *H04R 2420/07* (2013.01)

(58) Field of Classification Search
CPC ..... H04R 5/0335; H04R 2420/07; H04R 1/1016; H04R 1/1058; H01Q 1/273; H01Q 7/005
USPC ..... 381/74; 343/718
See application file for complete search history.

(56) References Cited

U.S. PATENT DOCUMENTS

2016/0050474 A1* 2/2016 Rye ..... H05K 7/08 381/152

* cited by examiner

*Primary Examiner* — Paul Kim
(74) *Attorney, Agent, or Firm* — Lowenstein Sandler LLP

(57) ABSTRACT

An electronic device that includes a metal element arranged to at least partially cover a high impedance region associated with an antenna of the electronic device. The metal element presents a capacitive load to the antenna to mimic or replicate a capacitance placed on the antenna by a conductive element, such as a user's finger, coming in contact or close proximity to the antenna area. The capacitive load applied by the metal element tunes the antenna system for a large capacitance to resist antenna de-tuning and radio link interruption caused by the unintended user contact or near contact with the high impedance region of the antenna.

20 Claims, 11 Drawing Sheets

CAPACITANCE LOADED ANTENNA FOR EAR-WORN ELECTRONIC DEVICE

BACKGROUND

A large and growing population of users enjoy music and other audio content using wireless listening devices. For example, ear-worn or in-ear wireless earphones provide users with flexibility and convenience in listening to audio content, without having to physically connect a wire to an audio source (e.g., a mobile device, a television, etc.). In-ear wireless earphones provide for touch-based user interaction to control functionality of the earphones (e.g., playback functionality, volume control, etc.) In order to maximize user comfort, the in-ear earphones, the form factor of the device is limited in size, resulting in the various components of the device being in close proximity to one another.

BRIEF DESCRIPTION OF DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1A:
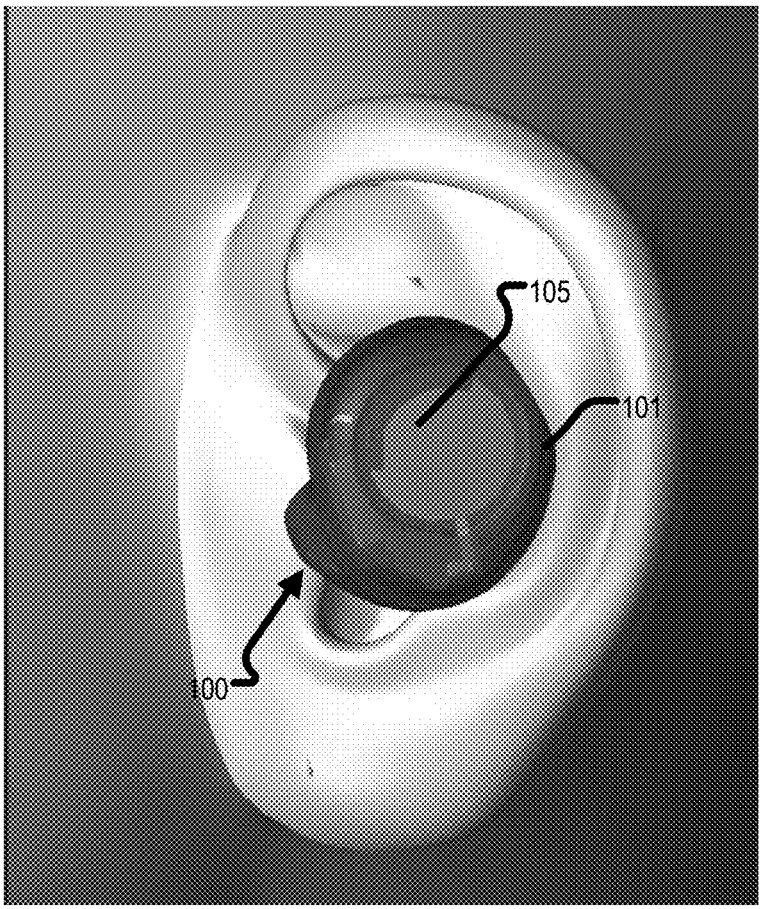
FIG. 1A shows an example wireless earbud situated in an ear of a user, according to one embodiment.

In-ear wireless electronic devices (referred to herein as "earbuds" or "wireless earbuds") are traditionally size limited for user comfort. Accordingly, conventional wireless earbuds are sized to fit comfortably within a user's ear, while enclosing various components to enable operation of the earbuds, including, for example, one or more touch sensing controls. Due to the wireless nature of these earbuds, the earbud includes an antenna system to wirelessly receive a radio transmission from an audio source and transmit signals to the audio source. The size limitation in conventional ear-worn devices results in constraints on the physical volume and positioning of the antenna system within the earbud. As a result, the antenna system is in physical proximity to the one or more controls of the earbud (e.g., a touch sensing controller arranged on an exterior of the earbud to enable a user to control operations of the earbud (e.g., playback, volume, power, etc.)) The physical proximity of the antenna system to the earbud control elements leads to unintended contact by the user with portions of the earbud that impact the antenna tuning, efficiency, radio link connectivity, range, media playback, and customer experience. The application of a large capacitance by a conductive element (e.g., a user's finger) inadvertently touching a region of the housing of the earbud proximate to the antenna results in an undesirable de-tuning of the antenna and reduction in antenna efficiency.

The embodiments described herein may address the above noted deficiencies by an electronic device (e.g., a wireless earbud device) that includes a metal element arranged to cover a high impedance region associated with an antenna system of the electronic device. In one embodiment, the antenna's high impedance region is located at a tip or physical end of the antenna structure (i.e., an area where the antenna structure terminates or comes to a physical end). In one embodiment, the metal element presents a capacitive load to the antenna to mimic or replicate a capacitance value placed on the antenna by a conductive object, such as a user's finger. In one embodiment, the capacitance load presented by the metal element is in a range of capacitance values that substantially corresponds to a range of capacitance values caused by contact by a conductive element with the first portion of the outer surface of the housing.

In one embodiment, the earbud includes a touch sensing layer or pad to enable a user to control functionality of the earbud (e.g., playback operation, volume setting, powering on/off, wireless connection pairing, etc.). Due to the form factor of the ear-worn electronic device, the touching sensing pad is in physical proximity to the antenna system. This physical proximity leads to unintended contact or near contact by the user's finger with a high impedance region of the antenna system. The capacitive load applied by the metal element tunes the antenna system for a large capacitance to resist antenna de-tuning caused by unintended user contact or near contact with the high impedance region of the antenna system. Advantageously, in comparison to the capacitive load applied by the metal object, a human finger touch is perceived as an incremental capacitance change, thereby resisting undesirable antenna de-tuning and efficiency impact.

In one embodiment, the antenna structure or system may be disposed on an inner surface of a housing of an earbud. In this description, one earbud of an earbud pair is described in detail. In one embodiment, a touch sensing layer or pad is disposed on an outer surface of the earbud housing. As noted above, the touch sensing pad is in physical proximity with the antenna system, such that the earbud is prone to inadvertent user touching of a portion of the housing that corresponds to a high impedance region of the antenna system. In one embodiment, the antenna system may include a folded monopole structure including a tip or end of the antenna element that represents a high electric-field region that is sensitive to frequency de-tuning in the presence of a capacitive object or element (e.g., a user's finger).

In one embodiment, the metal object is disposed on an outer surface of the earbud housing. The metal object may be arranged such that it at least partially covers the underlying antenna structure. In one embodiment, the metal object at least partially shields the high impedance region of the antenna structure and applies or pre-loads the antenna structure with a capacitance having a value in a first range. According to embodiments, the capacitive load applied by the metal element is in a range that corresponds to a range of capacitive values placed on the antenna structure by a conductive element (e.g., a human finger). Advantageously, the metal element pre-loads the antenna system with the capacitance (herein referred to as the "capacitive load") to offset an external capacitance caused by contact or near contact with a portion of the housing proximate to the antenna structure.

The electronic device may connect to a source via a suitable communications protocol to obtain a radio signal from a source (e.g., a mobile phone, a television, a computing device, etc.) for playback via a speaker system of the electronic device. Several topologies of antenna structures are contemplated herein. The antenna structures described herein can be used for wireless area network (WAN) technologies, such as cellular technologies including Long Term Evolution (LTE) frequency bands, third generation (3G) frequency bands, Wi-Fi® and Bluetooth® frequency bands or other wireless local area network (WLAN) frequency bands, and so forth.

Although the description herein relates to a wireless earbud, other electronic devices may be used in connection with the embodiments of the present application. In this regard, the embodiments of the present application may be used in connection with any suitable computing device including an antenna having a high impedance region prone to contact by a conductive element. In these instances, the antenna and corresponding high impedance region may be at least partially covered by a metal element configured to apply a capacitive load to the antenna to offset the detuning and efficiency loss that would be caused by the conductive element. In addition to the wireless earbuds described in detail herein, other electronic devices may be employed, such as, for example, a cellular phone, a tablet, a wireless speaker, etc.

Figure 1B:
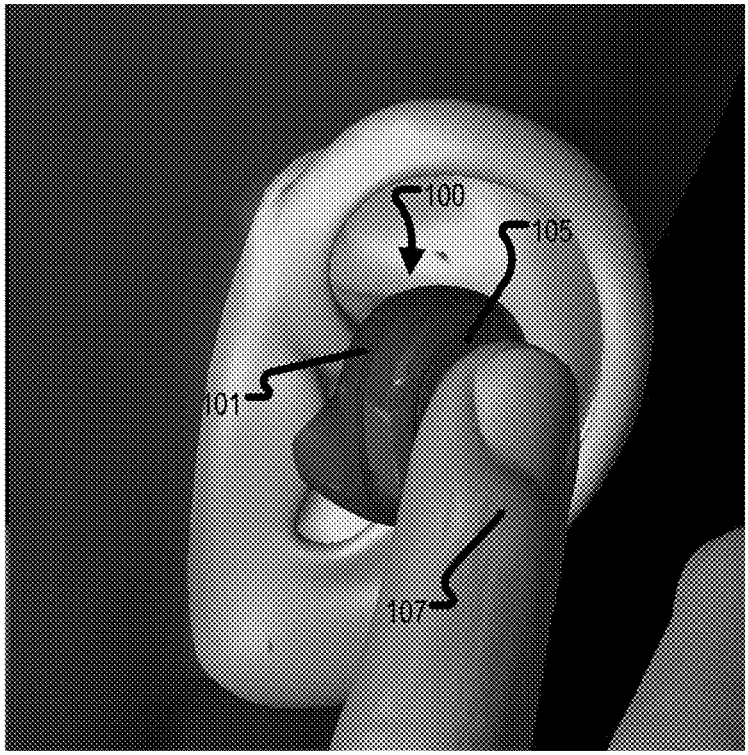
FIG. 1B illustrates an example in-ear wireless earbud with a user interaction with a touch sensing pad of the earbud, according to one embodiment.

FIG. 1A is a diagram of an antenna architecture of an electronic device 100 with a housing 101 having an outer surface with a touch sensing pad 105 to enable a user to control functionality of the electronic device 100. As shown in FIG. 1A, the electronic device is sized and shaped to be worn in a user's ear. The electronic device (herein referred to as a "wireless earbud") 100 includes an antenna system (not shown in FIG. 1A) configured to wirelessly receive a radio signal from an audio source for processing and playback by one or more speaker components of the earbud. As shown in FIG. 1B, a conductive element 107 (e.g., a user's finger) may be used to interact (e.g., touch or make contact) with the touch sensing pad 105 to control functionality of the wireless earbud 100. In one embodiment, a capacitance in a first capacitance range (herein also referred to as the "touch capacitance value range") is applied to the touch sensing pad 105 during normal or intended operation of the wireless earbud 100. The housing 101 is configured to enclose one or more components of the wireless earbud 100 including, for example, the antenna system, circuit board including a processing device for controlling one or more speaker components, etc.

Figure 2:
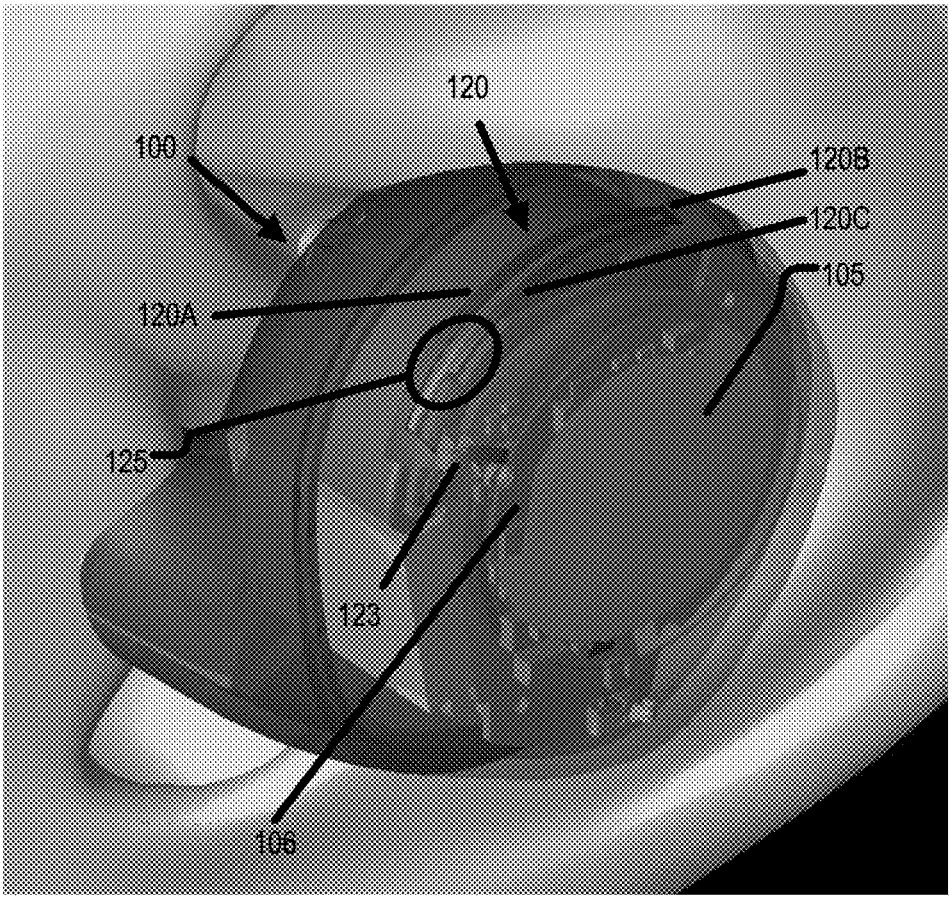
FIG. 2 depicts a side perspective view of an example in-ear wireless earbud with a touch sensing pad and a transparent portion of a housing showing an internal antenna and circuit board, according to one embodiment.

FIG. 2 depicts a side perspective view of an example in-ear wireless earbud 100 with the touch sensing pad 105 and a transparent portion of a housing showing an internal antenna structure 120 coupled to a printed circuit board (PCB) 106 by a radio frequency (RF) feed 123, according to one embodiment. In one embodiment, the RF feed 123 may be a feed line connecter that carries RF signals to and/or from the antenna structure 120. In the example shown, the antenna structure 120 is a folded monopole antenna including a first antenna segment 120A, a second antenna segment 120B, and a third antenna segment 120C. In one embodiment, a first end of the first antenna segment 120A is coupled to the printed circuit board 106 by RF feed 123. In one embodiment, the first antenna segment 120A extends from the first end in a first direction to a second end coupled to a first end of the second antenna segment 120B.

In one embodiment, as shown in FIG. 2, the first end of the first antenna segment 120A may include an additional segment extending perpendicularly relative to the first direction (i.e., folded in) at the coupling point with the feed 123. The second antenna segment 120B extends in a perpendicular direction relative to the first direction from the first end to a second end coupled to a first end of the third antenna element 120C. The third antenna element 120C extends in the first direction (parallel to the first antenna element 120A) from the first end to a second end. In one embodiment, the second end of the third antenna element 120C is a tip or physical end point (i.e., an open end) of the antenna structure 120 and represents the high impedance region (or high electric-field region) 125 of the antenna structure 120. In one embodiment, the antenna structure 120 is disposed on an inner surface of the housing of the wireless earbud 100.

In one embodiment, the antenna structure 120 is electrically coupled to a ground plane (not shown in FIG. 2). In one embodiment, the ground plane may be a layer or surface of the printed circuit board 106. In one embodiment, the ground plane may be a metal frame of the electronic device. In one embodiment, the ground plane may be a system ground or one of multiple grounds of the electronic device. According to embodiments, the antenna structure 120 is placed in a manner such that it is biased toward the free space (i.e., away from the ear) to maximize the efficiency of the antenna structure 120. Although FIG. 2 illustrates a folded monopole antenna 120, other suitable antenna structure and configurations may be employed in accordance with embodiments of the present application, including, for example, a loop antenna, an inverted-S antenna, a slot antenna, a patch antenna, etc.

In one embodiment, the touch sensing pad 105 is coupled to the printed circuit board 106 for the transmitting the one or more signals via one or more touch electrodes of the touch sensing pad 105 to the printed circuit board 106 to control operation and functionality of the wireless earbud 100. The touch sensing pad 105 may include single capacitive sensor elements (e.g., electrodes) or elements arranged in multiple dimensions for detecting a presence of the conductive element on the touch sensing pad 105. Regardless of the method, usually an electrical signal representative of the capacitance detected by each capacitive sensor is processed by a processing device, which in turn produces electrical or optical signals representative of the contact of the conductive element (e.g., a finger) in relation to the touch sensing pad 105.

Figure 3:
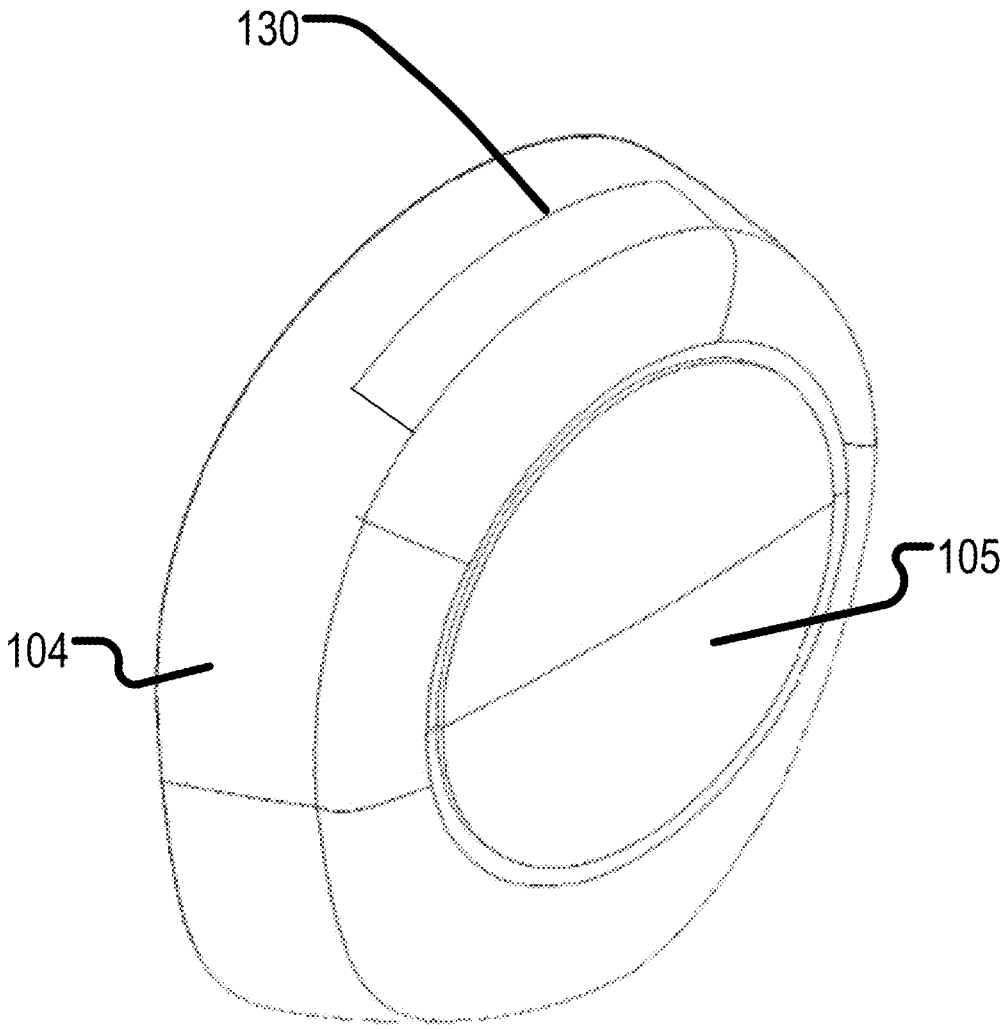
FIG. 3 illustrates of a portion of a housing of a wireless earbud showing a metal element covering a high impedance region associated with an antenna of the earbud, according to one embodiment.

FIG. 3 illustrates a side perspective view of an outer portion 104 of a housing of a wireless earbud, according to one embodiment. The outer portion 104 includes an outer surface of the housing upon which the touch sensing pad 105 is disposed. As shown in FIG. 3, a metal element 130 is disposed on the outer surface of the outer portion 104 of the housing in a position to cover at least a portion of the underlying antenna structure (not shown in FIG. 3). In an embodiment, the metal element 130 may have any suitable configuration, such as a solid configuration or a mesh configuration. In an embodiment, the metal element 130 is sized and shaped to cover at least a portion of the geometry (e.g., surface area) of an antenna structure disposed on an inner surface of the housing. A tip or physical end point of the antenna structure (e.g., a tip of the antenna that is opposed to a distal end that is connected to a feed) is a high impedance region with a degree of sensitivity to frequency de-tuning in the presence of a conductive element (e.g., a user's finger). In one embodiment, the metal element 130 covers at least the tip or physical end point of the antenna structure (e.g., an end point of the antenna corresponding to the high impedance region) and extends to cover a percentage (e.g., 50-95%) of the surface area of the antenna structure. In one embodiment, the metal element 130 covers approximately 50%-70% of the surface area of the antenna structure to provide for desired de-tuning effects (e.g., maximum protection against de-tuning caused by a conductive element). In one embodiment, the metal element 130 is disposed on the outer surface of the housing such that it covers a portion of the antenna structure beginning at a tip or open-end and extending along the surface of the antenna structure such that approximately 50%-70% of the antenna structure is covered. In one embodiment, the metal element 130 is arranged such that a portion of the underlying antenna structure is not covered by the metal element (e.g., a percentage of approximately 5%-30% of the geometry of the antenna structure). In one embodiment, the portion of the antenna structure coupled to the RF feed is not covered by the metal element 130.

Figure 4:
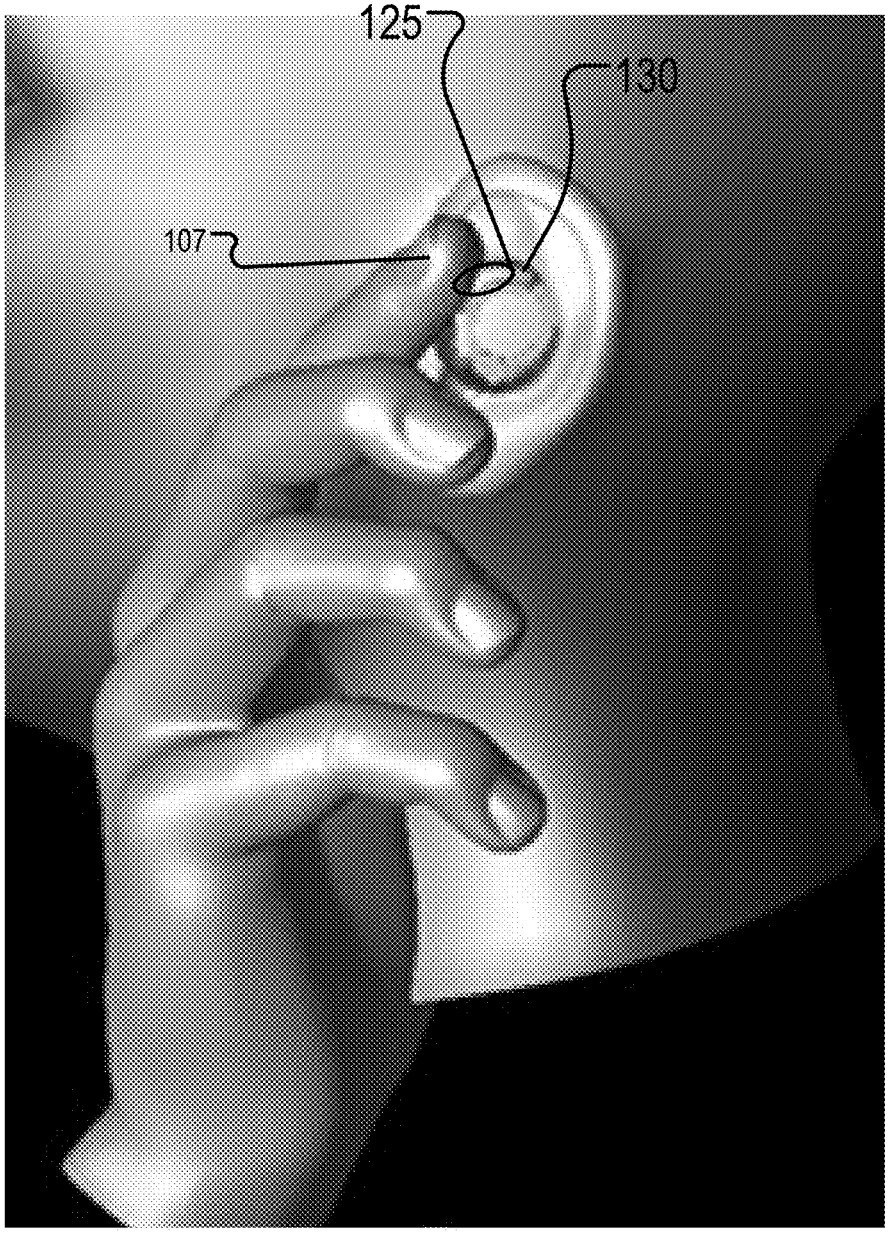
FIG. 4 shows a user's finger making contact with a high impedance region associated with an antenna of an in-ear wireless earbud, according to one embodiment.

In one embodiment, the antenna structure is disposed on the inner surface of the outer portion 104 of the housing, thereby creating the high impedance region 125. In one embodiment, the antenna structure is in close physical proximity to the touch sensing pad 105. As shown in FIG. 4, this close physical proximity between the antenna structure and the touch sensing pad 105 results in unintended contact or near contact by a conductive element 107 with the high impedance region 125 of the antenna. Advantageously, placement of the metal element 130 at least partially covering the high impedance region 125 of the antenna provides for the application of the capacitive load on the antenna which serves to offset the deleterious effects of the introduction of a capacitance by an element 107 touching or in proximity to the high impedance region 125.

For example, a conventional in-ear wireless earbud including a monopole antenna and no capacitance-loading metal element operating without a conductive object in contact with a portion of the housing corresponding to a high impedance region of the antenna operating at approximately 2.44 GHz may exhibit an antenna impedance of (41+j 4) Ohms. In this example, the antenna is appropriately impedance-matched to a 50 Ohms system impedance. However, upon introduction of contact by a conductive object with a portion of the housing corresponding to the high impedance region of the antenna, the antenna impedance changes to approximately (11−j 27) Ohms (i.e., approximately equivalent to an impedance change due to a 4 pF to 6 pF shunt capacitor).

In one embodiment, in comparison to the example above, an in-ear wireless earbud including a monopole antenna and a capacitance-loading metal element operating without a conductive object in contact with a portion of the housing corresponding to a high impedance region of the antenna operating at approximately 2.44 GHz may exhibit an antenna impedance at approximately 2.44 GHz of (41+j 4) Ohms. In one embodiment, the metal element pre-tunes the antenna with a capacitive loading approximately equivalent to a 3pF shunt capacitor. Advantageously, the pre-loaded capacitance presented by the metal element prevents severe de-tuning caused by a finger touch in an area of the housing covering the antenna structure.

Figure 5:
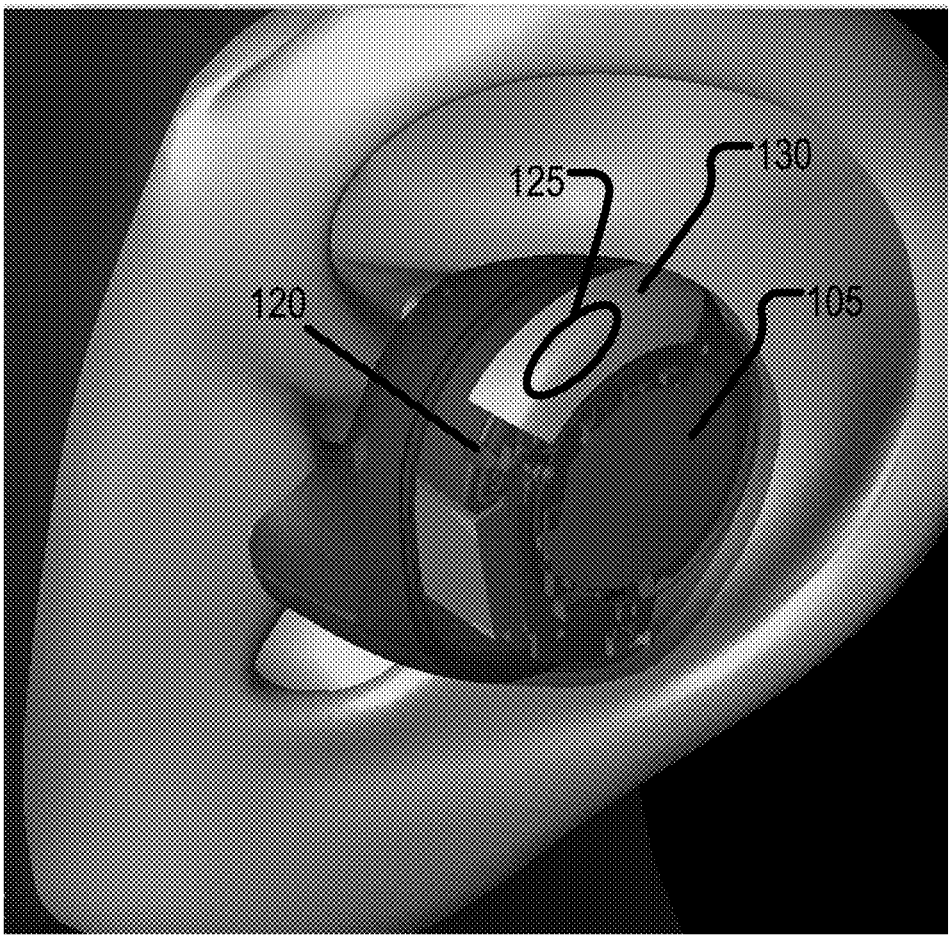
FIG. 5 depicts a side perspective view of an example in-ear wireless earbud with a touch sensing pad and a metal element disposed on an outer surface of a housing of the in-ear wireless earbud, according to one embodiment.

FIG. 5 illustrates an in-ear wireless earbud including the metal object 130 disposed on an outer surface of a housing. In FIG. 5, for illustration purposes, a portion of the housing is removed or made transparent to show a portion of an antenna structure 120 disposed on an inner surface of the housing. As shown, the antenna structure 120 is at least partially covered by the metal element 130. In one embodiment, a portion of the antenna structure 120 is not covered by the metal element 130 to improve efficiency of the antenna's operation.

The metal element 130 may cover a percentage of the geometry of the antenna (e.g., 50%-95%) including the high impedance region 125 of the antenna. The metal element 130 applies a capacitive load to the antenna structure 120 such that the antenna structure 120 is tuned for operation under the capacitive load. Advantageously, the capacitive load offsets a capacitance caused by unintended contact or near contact by a conductive element (e.g., a user's finger) at or near a portion of the housing wherein the antenna structure is disposed. In one embodiment, the metal element 130 is arranged in a manner to apply the capacitive load in a range of capacitance values that at least substantially matches a capacitance seen by the antenna structure120 in the presence of an external conductive element (e.g., a human finger, as shown in FIG. 4). In one embodiment, a value of the capacitive load is preset in a range of values to match a range of capacitance values corresponding to contact or near contact by a conductive element in the high impedance region o125 of the antenna structure.

Figure 6A:
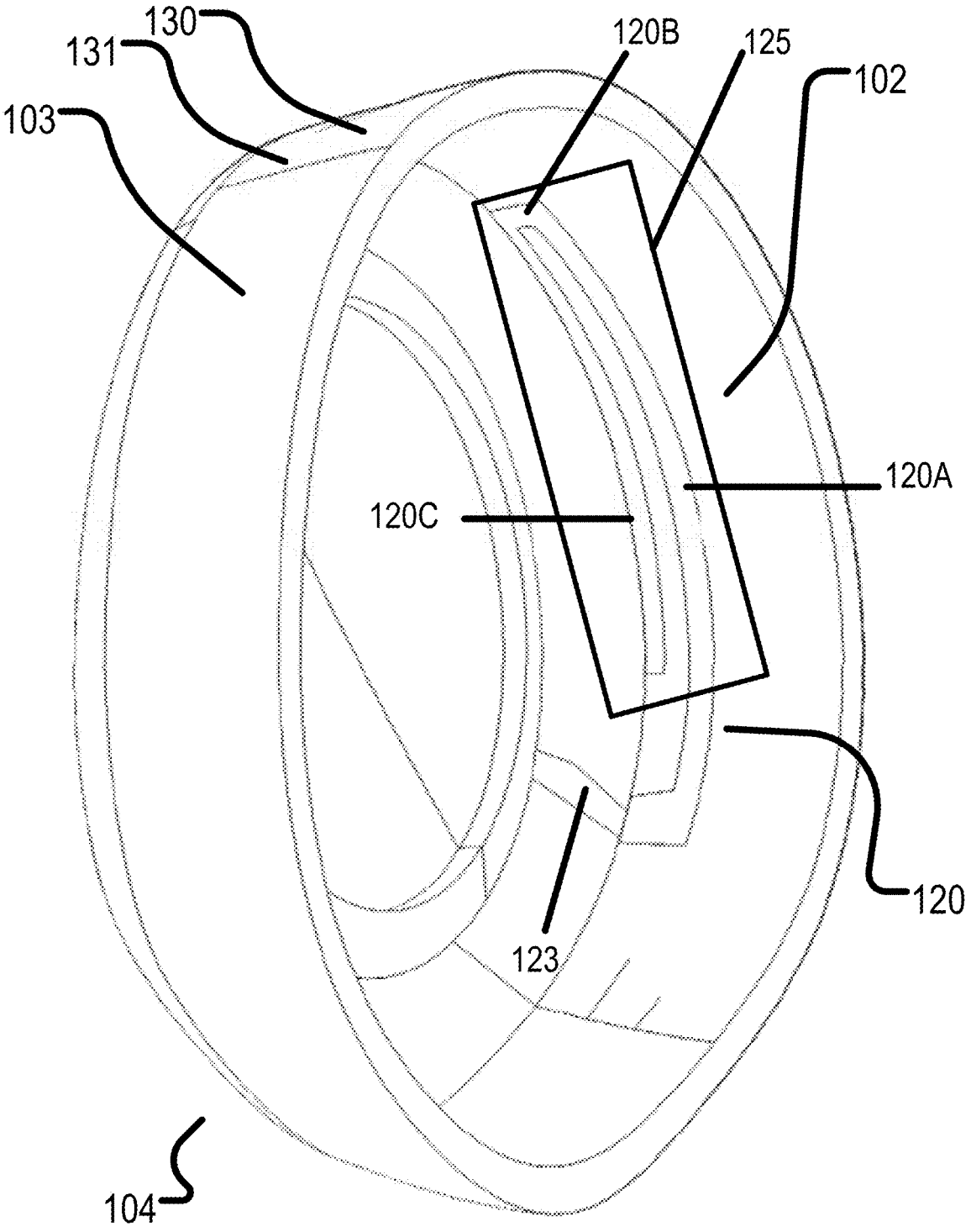
FIG. 6A depicts a side perspective view of a portion of a housing of a wireless earbud, according to one embodiment.

FIG. 6A shows a side perspective interior view of an outer portion 104 of a housing of a wireless earbud, according to one embodiment. As shown in FIG. 6A, the antenna structure 120 (a folded monopole antenna having a first antenna element 120A, a second antenna element 120B, and a third antenna element 120C, in this example) is disposed on an inner surface 102 of the outer portion 104 of the housing. As described above, the antenna may have a high impedance region 125 corresponding to an open end or tip of the antenna structure (e.g., a second or open end of the third antenna element 120C).

In one embodiment, the metal element 130 is disposed on an outer surface 103 of the housing. As shown in FIG. 6A, the metal element 130 has a first end denoted by line 131 and along the outer surface of the housing to a second end (not shown in FIG. 6A). In the example shown, the metal element 130 is arranged to cover at least a percentage of the geometry of the antenna structure 120 and its corresponding high impedance region 125.

Figure 6B:
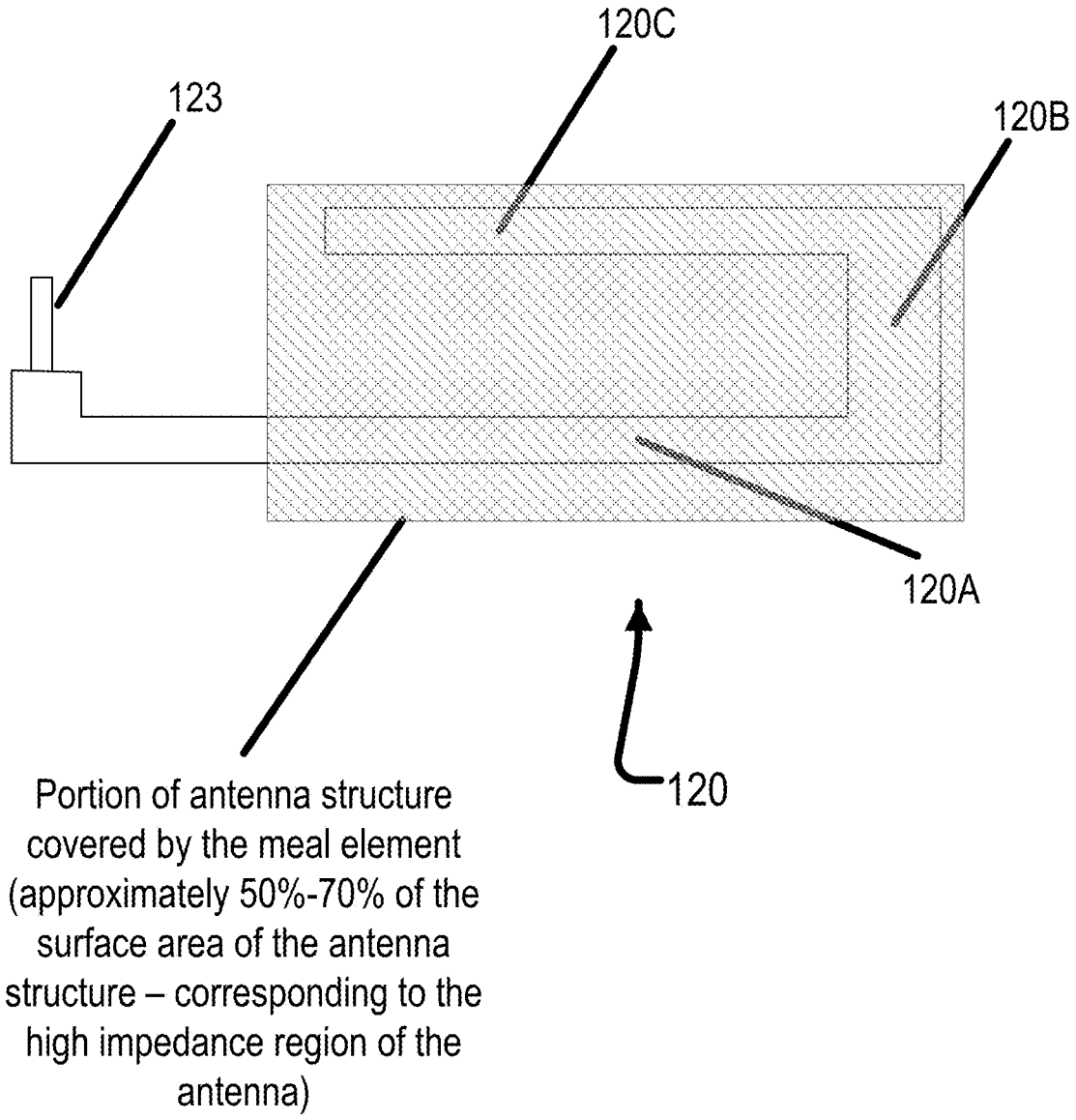
FIG. 6B depicts a portion of an antenna structure covered by a metal element, according to one embodiment.

In one embodiment, the metal element (not shown in FIG. 6B) is disposed on an outer surface of the housing to covers a portion of the antenna structure 120 starting from a tip or open end of the third antenna element 120C and extends over the third antenna element 120C, the second antenna element 120B, and a portion of the first antenna element 120A, such that approximately 50%-70% of the surface area of the antenna structure 120 is covered, as denoted by the rectangular box shown in FIG. 6B. In one embodiment, the covered portion 125 of the antenna structure 120 corresponds to the high impedance region of the antenna structure 120. In one embodiment, a portion of the first antenna element 120A coupled to the feed 123 is not covered by the metal element 130.

In one embodiment, the floating metal element130 is a discrete element that is not physically connected to other components of the wireless earbud and, as such, creates a high capacitance for loading the antenna. In one embodiment, the large capacitance applied by the floating metal element 130 is used to simulate or mimic a capacitance experienced by the antenna structure 120 by a finger or other conductive element. Accordingly, the capacitance applied by floating metal element 120 may be used to tune the antenna structure 120. In one embodiment, the floating metal element 130 may be electrically coupled to a directly fed component of the wireless earbud, such as a printed circuit board. In one embodiment, there is gap between the floating metal element 130 and the antenna structure 120.

Figure 7A:
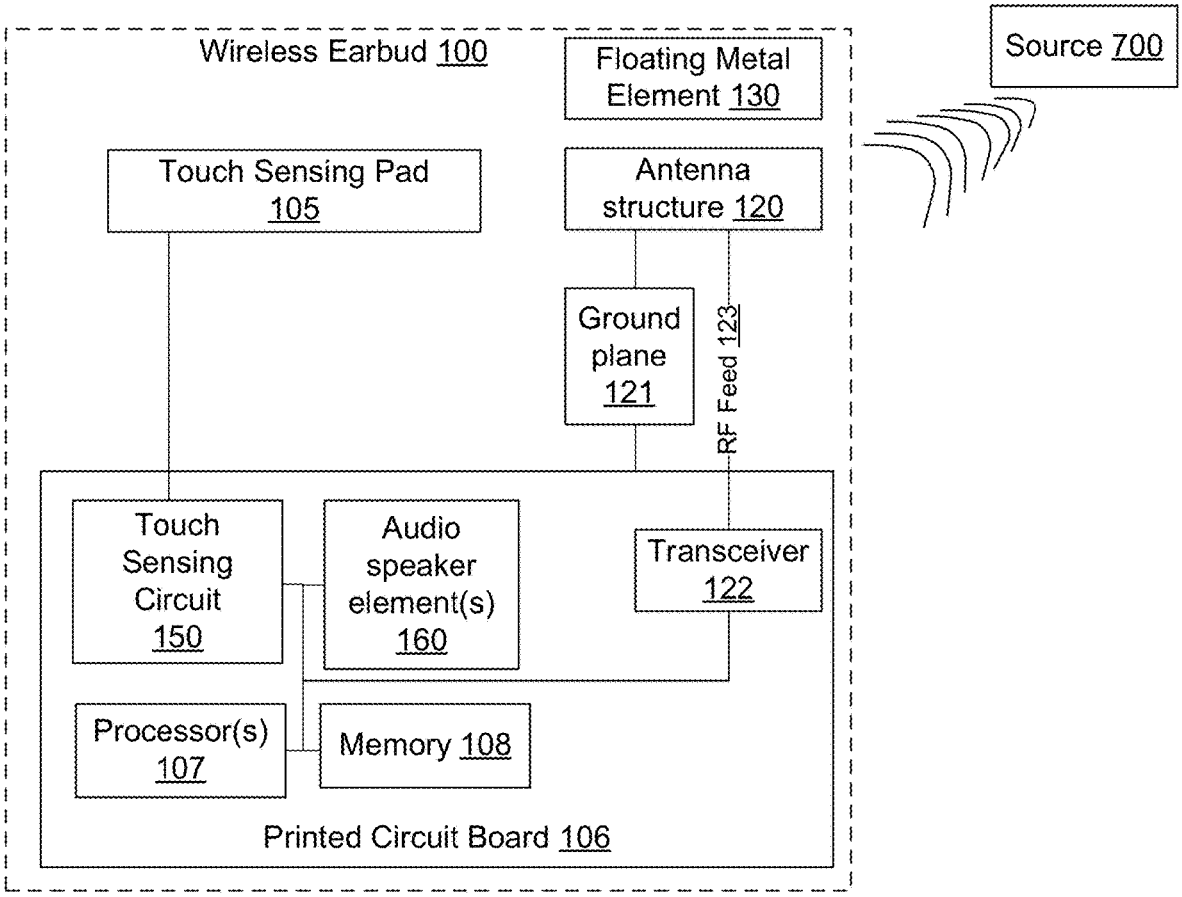
FIG. 7A is a diagram showing components of a wireless earbud including a metal element to cover a high impedance region associated with an antenna in communication with an audio source, according to one embodiment.

FIG. 7A is a diagram showing various components of a wireless earbud 100, according to one embodiment. The wireless earbud 100 can include a printed circuit board 106 including one or more components configured to enable the earbud functionality. In one embodiment, a touch sensing circuit 150, one or more audio speaker elements 160, a processing device 107, a transceiver 122, and a memory 108 are disposed on the printed circuit board 106.

In one embodiment, the touch sensing circuit 150 may be coupled to a touch electrode or touch sensing pad 105. In one embodiment, one or more sensor lines may be connected to one or more touch electrodes or sensors and supply an electrical charge in the touch sensors of the touch sensing pad 105 to the touch sensing circuit 150. In one embodiment, the touch sensing circuit pad 105 detects a touch of a conductive element (e.g., a finger) and sends a corresponding signal to the touch sensing circuit 150 for processing. In one embodiment, when a conductive object (e.g., a finger, hand, or other object) comes into contact or close proximity with the touch electrode of the touch sensing pad 105, the capacitance changes and the conductive object is detected. The capacitance changes of the capacitive touch sense elements of the touch sensing pad 105 can be measured by a touch sensing circuit 150. In one embodiment, the touch sensing circuit 150 may process the signal from the touch sensing pad 105 to control operation of the one or more audio speaker elements 160 of the wireless earbud 100. In one embodiment, the touch sensing circuit 150 converts the measured capacitances of the capacitive sense elements into digital values for processing by the processor(s) 107. The one or more processor(s) 107 may include one or more CPUs, microcontrollers, field programmable gate arrays, or other types of processors. The wireless earbud 100 may also include system memory 108, which may correspond to any combination of volatile and/or non-volatile storage mechanisms. The system memory 108 stores instructions for the execution of the wireless earbud functionality using the processor(s) 107, such as the operation of the wireless earbud to control the audio speaker element(s) 160 based on signals received via the touch sensing circuit 150 and the antenna structure 120.

In one embodiment, the wireless earbud 100 includes the antenna structure 120 configured to receive a wireless signal from a source device 700. The source device 700 may be any suitable transmitter of a wireless signal, including, for example, a mobile device, a television, a computer, etc. In one embodiment, the antenna structure 120 is electrically coupled to a ground plane 121. In one embodiment, an RF feed 123 couples the antenna structure 120 to a transceiver 122 disposed on the printed circuit board 106. In one embodiment, the transceiver 122 measures the RF signal of the antenna structure 120 and generates a corresponding digital signal. In one embodiment, the transceiver 122 outputs the digital signal to the one or more processor(s) 107 for the production of a corresponding audio signal. In one embodiment, the processor(s) 107 may transmit the audio signal to the audio speaker elements 160 to produce an audio output corresponding to the RF signal received by the antenna structure 120.

Although FIG. 7A relates to a wireless earbud 100, embodiments of the present application may be implemented in any type of computing device, such as an electronic book reader, a PDA, a mobile phone, a laptop computer, a portable media player, a tablet computer, a camera, a video camera, a netbook, a desktop computer, a gaming console, a DVD player, a Blu-ray®, a computing pad, a media center, a voice-based personal data assistant, and the like. Alternatively, the electronic device 705 can be any other device used in a WLAN network (e.g., Wi-Fi® network), a WAN network, a cellular network, a Bluetooth network, or the like.

The antenna structure can receive different frequency bands, such as WAN frequency bands, cellular frequency bands including Long Term Evolution (LTE) frequency bands, third generation (3G) frequency bands, fourth generation (4G) frequency bands, Wi-Fi® frequency bands, Bluetooth® frequency bands, or other wireless local area network (WLAN) frequency bands. It should be noted that the Wi-Fi® technology is the industry name for wireless local area network communication technology related to the IEEE 802.11 family of wireless networking standards by Wi-Fi Alliance. The antenna structure 120 may include RF modules and/or other communication modules, such as a WLAN module, a GPS receiver, a near field communication (NFC) module, an amplitude modulation (AM) radio receiver, a frequency modulation (FM) radio receiver, a PAN module (e.g., Bluetooth® module, Zigbee® module), a GNSS receiver, and so forth.

The floating metal element 130 is arranged to cover at least a portion or percentage of the antenna structure 120. In one embodiment, the floating metal element 130 is electrically coupled to the printed circuit board 106, while having no physical connection to the other components of the wireless earbud 100.

Figure 7B:
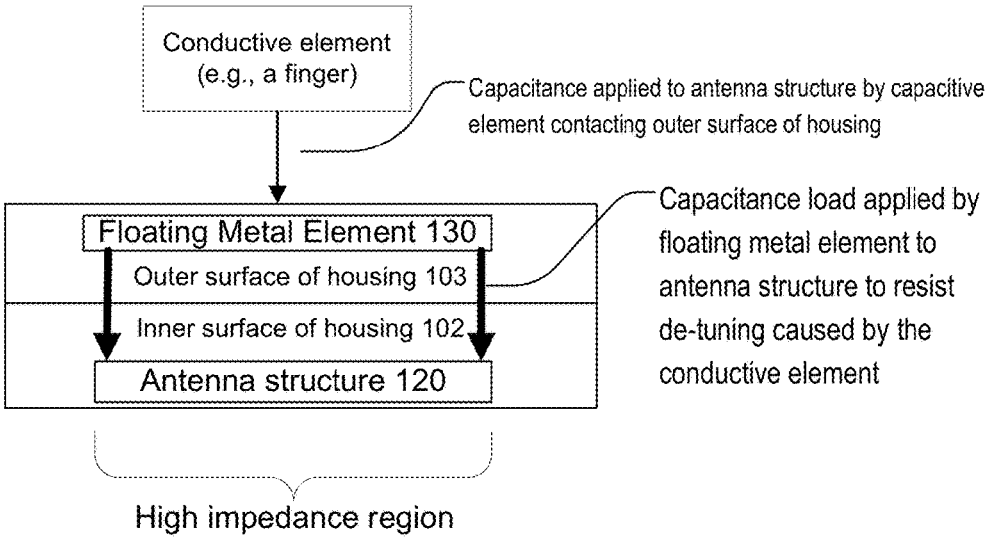
FIG. 7B is a diagram showing a capacitive load applied by a metal element to an antenna structure to resist de-tuning caused by a capacitance applied to the antenna structure by a conductive element contacting or in close proximity to an outer surface of a housing of a wireless earbud, according to one embodiment.

FIG. 7B is a diagram showing the arrangement of the floating metal element disposed on an outer surface 103 of a housing of a wireless earbud. The antenna structure 120 disposed on an inner surface 104 of the housing of the wireless earbud. As shown in FIG. 7B, the floating metal element 130 presents a capacitive load to the antenna structure 120 to resist de-tuning caused by a conductive element when in contact or close proximity to a high impedance region of the antenna structure 120. In an embodiment, a portion of the outer surface of the housing upon which the floating metal element is disposed covers a percentage of a portion of the inner surface of the housing 102 upon which the antenna structure is disposed. In one embodiment, the portion of the outer surface including the floating metal element covers approximately 50%-70% of the portion of the inner surface including the antenna structure.

Figure 8:
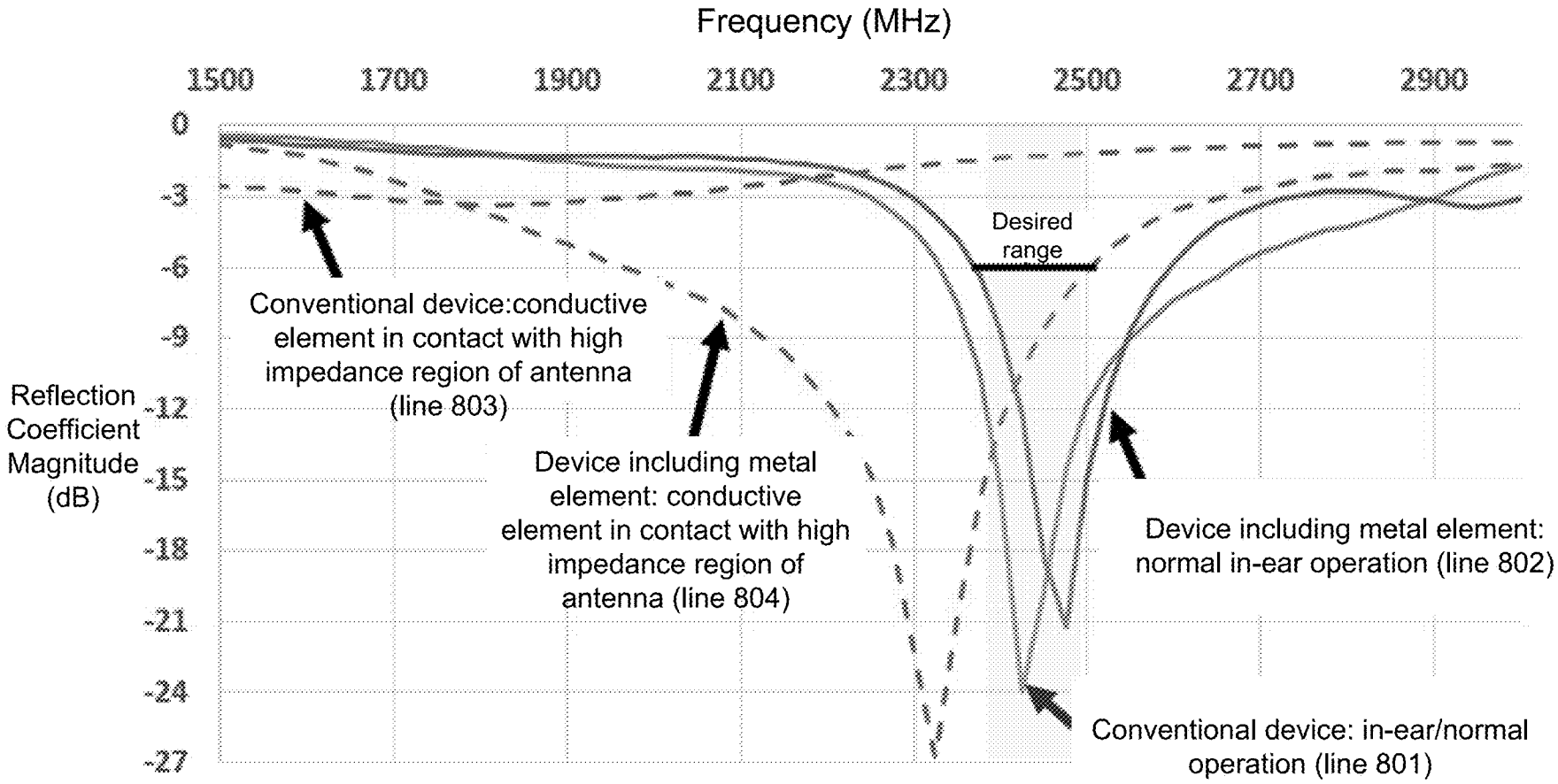
FIG. 8 is a graph of measured return loss data for various states of a conventional earbud device and an earbud including a metal element cover for an antenna structure, according to one embodiment.

FIG. 8 is a graph of measured return loss data for various states of a conventional earbud device and an earbud including a metal element cover for an antenna structure, according to one embodiment. The graph in FIG. 8 represents performance based on a desired or target frequency range of 2400-2485 MHz coverage with respect to a −6dB return loss criteria. In FIG. 8, line 801 represents a measurement of a reflection coefficient magnitude in decibels (dB) (Y axis) versus frequency in MHz (X axis) for a conventional earbud device during normal in-ear operation. In FIG. 8, line 802 represents to a measurement of a reflection coefficient magnitude versus frequency for a wireless earbud having a metal element at least partially covering an antenna according to embodiments of the present application during normal in-ear operation. In FIG. 8, line 803 represents a measurement of a reflection coefficient magnitude versus frequency for a conventional earbud device when a conductive element is in contact with a high impedance region of an antenna. In FIG. 8, line 804 represents a measurement of a reflection coefficient magnitude versus frequency for a wireless earbud device having a metal element at least partially covering an antenna according to embodiments of the present application when a conductive element is in contact with a high impedance region of the antenna. As shown by lines 801 and 803, the conventional antenna suffers from severe de-tuning (approximately 500 MHz) in the presence of a finger touch in the high impedance region with poor in-band response (2.4 GHz). In contrast, the wireless earbud according to embodiments of the present application maintains at least approximately −6dB impedance matching (S-Parameter) in the presence of a finger touch in the high impedance region, as shown by lines 802 and 804.

Figure 9:
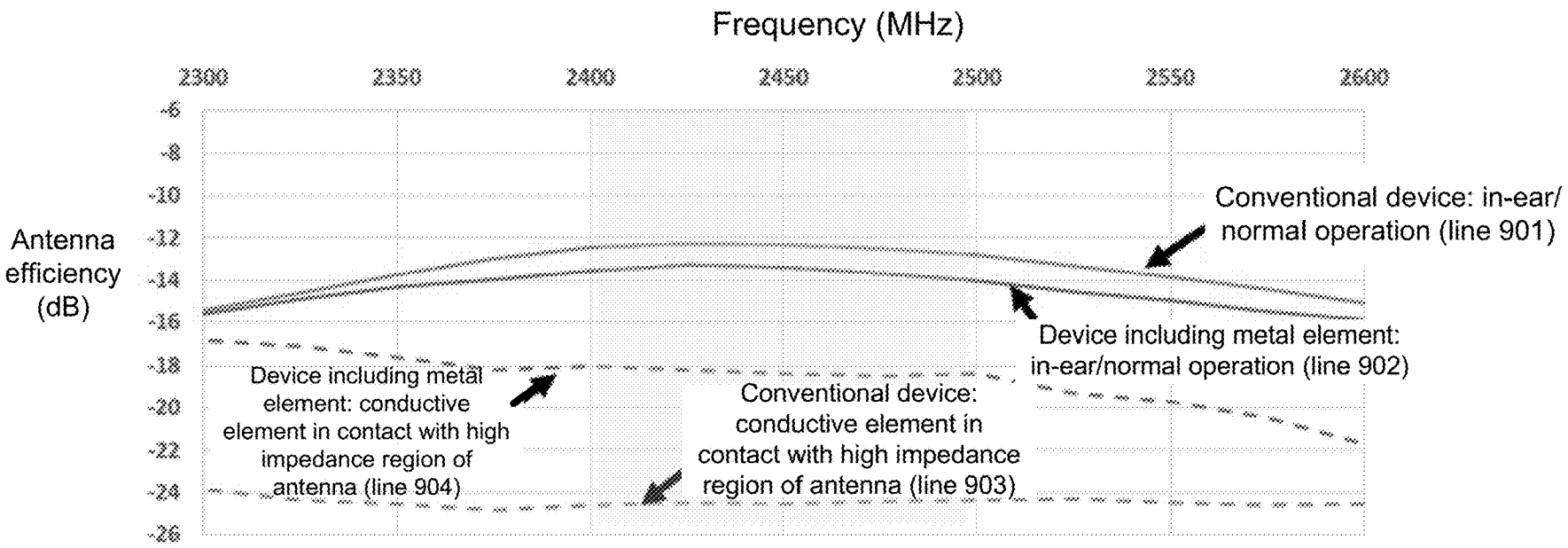
FIG. 9 is a graph of measured antenna efficiency data for various states of a conventional earbud device and an earbud including a metal element cover for an antenna structure, according to one embodiment.

FIG. 9 is a graph of measured antenna efficiency data for various states of a conventional earbud device and an earbud including a metal element cover for an antenna structure according to embodiments of the present application. The graph in FIG. 9 represents performance based on a desired or target frequency range of 2400-2485 MHz coverage with respect to a −6dB return loss criteria. In FIG. 9, line 901 represents a measurement of antenna efficiency in dB (Y axis) versus frequency in MHz (X axis) for a conventional earbud device during normal in-ear operation. In FIG. 8, line 902 represents to a measurement of antenna efficiency versus frequency for a wireless earbud having a metal element at least partially covering an antenna according to embodiments of the present application during normal in-ear operation. In FIG. 9, line 903 represents a measurement of antenna efficiency versus frequency for a conventional earbud device when a conductive element is in contact with a high impedance region of an antenna. In FIG. 9, line 904 represents a measurement of antenna efficiency versus frequency for a wireless earbud device having a metal element at least partially covering an antenna according to embodiments of the present application when a conductive element is in contact with a high impedance region of the antenna. As shown by lines 901 and 903, the conventional antenna exhibits a significant efficiency drop (approximately 12 -dB) when a finger touches the antenna. In comparison, as shown by lines 902 and 904, the wireless earbud according to embodiments of the present application maintains antenna efficiency and exhibits a small drop (approximately a 5 -dB) while the a conductive element is in contact or near contact with the metal element (e.g., in the high impedance region of the antenna). Advantageously, this improvement to antenna efficiency enables the wireless earbud to maintain an uninterrupted radio link with the audio source, even while a conductive element makes contact with a portion of the housing covering the antenna structure (e.g., a portion of the housing overlying at least a tip or open-end of the antenna structure).

As illustrated by the performance metrics shown in FIGS. 8 and 9, conventional wireless earbuds with conventional antenna designs for an in-ear form factor suffer from drawbacks of audio stuttering (e.g., interruption of the radio link with the source due to poor antenna efficiency) when a finger contacts an area of the housing in proximity to the antenna. In comparison, for the wireless earbud having an antenna at least partially covered by a metal element, a sufficient (e.g., uninterrupted or substantially uninterrupted) radio link is maintained for high quality audio playback while a finger is in contact with the antenna area. For example, when a mobile phone in free space serves as the audio source, the wireless earbud according to embodiments of the present application in the in-ear position with a finger placed on the antenna area maintains a strong, uninterrupted radio link at a range of approximately 12 feet before audio stuttering occurs, under walk-back test conditions. In contrast, a conventional earbud under the same conditions (i.e., a mobile phone source in free space with a finger placed on the antenna of an in-ear earbud) experiences interruptions and audio stuttering at between 2 feet and 6 feet in a standard walk-back test.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Figure 10A:
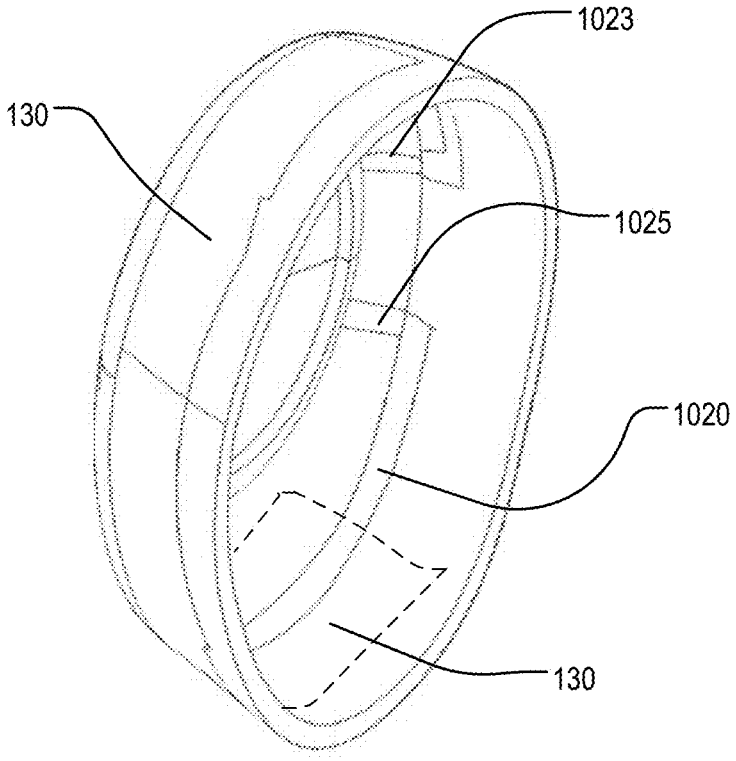
FIG. 10A depicts a side perspective view of a portion of a housing of a wireless earbud including a loop antenna, according to one embodiment.
Figure 10B:
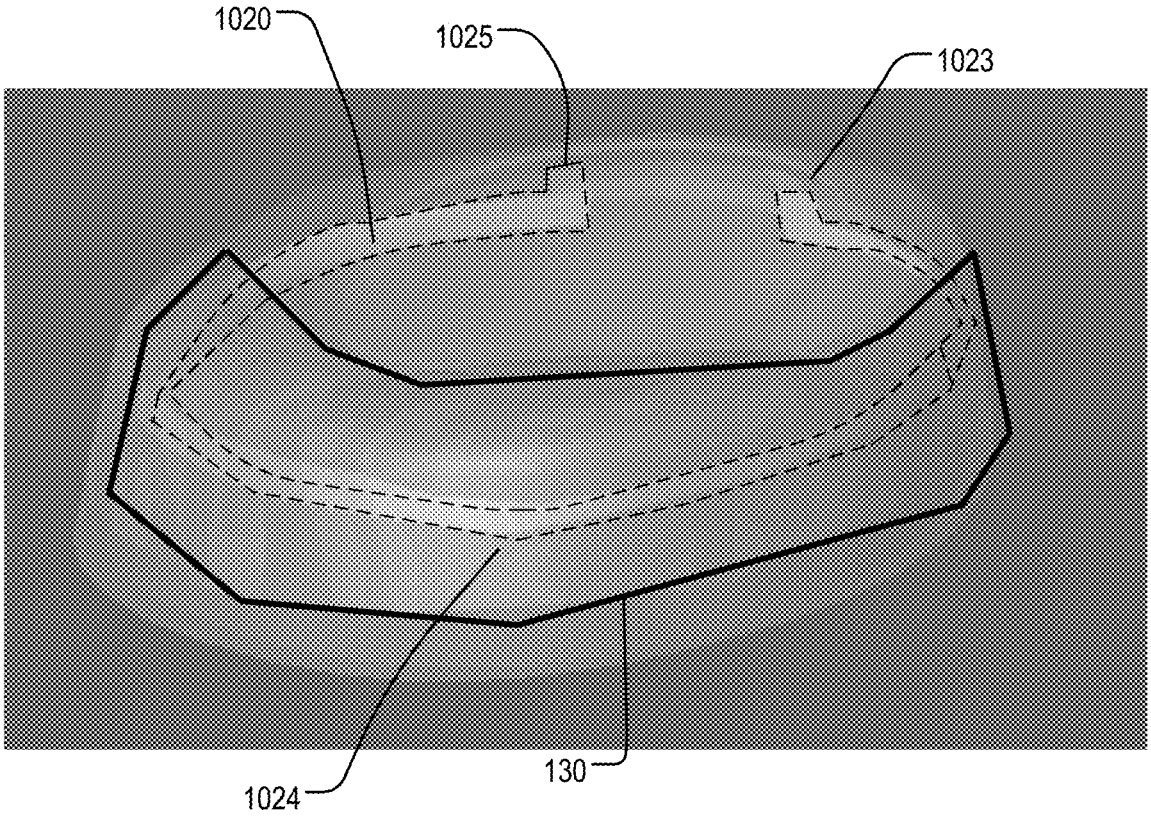
FIG. 10B depicts a side perspective view of a portion of a housing of a wireless earbud including a loop antenna and metal element, according to one embodiment.

As noted above, alternative antenna structures may be employed in accordance with the in-ear wireless earbud of the present disclosure. FIGS. 10A and 10B illustrate perspective views of a portion of a housing including a loop antenna structure 1020 and a metal element 130. As shown in FIG. 10A, the loop antenna structure 1020 is disposed on an interior surface of the housing and extends from a first end connected to PCB ground 1025 to a second end connected to an RF feed 1023. As shown in FIG. 10A, the metal element 130 is disposed on an outer surface of the housing and covers a portion of the loop antenna 1020. The dashed line in FIG. 10A denotes a portion of the metal element 130 that extends along the outside of the outer surface of the housing to cover the loop antenna 1020. As illustrated, the metal element 130 is placed on the outer surface of the housing such that the metal element 130 covers a desired percentage of the surface area of the loop antenna 1020. In one embodiment, the metal element 130 covers approximately 50%-70% of the surface area of the loop antenna 1020. In one embodiment, the end portions of the loop antenna 1020 that connect to the RF feed 1023 and the PCB ground 1025 are not covered by the metal element 130.

FIG. 10B illustrates a side perspective view of a portion of a housing of an in-ear wireless earbud, according to one embodiment. As shown, the metal element 130 is disposed on an outer surface of the housing and covers a portion of the loop antenna 1020. The loop antenna 1020 is disposed on an interior surface of the housing and is denoted with a dashed line. In one embodiment, a percentage (e.g., 50%-70%) of the surface area of the loop antenna 1020 is covered by the metal element 130. In one embodiment, the two end portions of the loop antenna 1020 connected to PCB ground 1025 and the RF feed 1023 are not covered by the metal element 130. In one embodiment, the metal element covers at least a portion the loop antenna including a point or portion distally located 1024 relative to the PCB ground 1025 and RF feed 1023 and extending to cover approximately 50%-70% of the surface of the loop antenna.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms that may refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. An apparatus comprising:

a housing comprising an inner surface and an outer surface;

an antenna disposed on a first portion of the inner surface of the housing;

a touch electrode disposed on the outer surface of the housing in proximity to the antenna; and a metal element disposed on a first portion of the outer surface of the housing, the first portion of the outer surface at least partially covering the first portion of the inner surface, wherein the metal element applies a first capacitive load to the antenna.

2. The apparatus of claim 1, wherein the antenna comprises an open-ended portion disposed on the first portion of the inner surface.

3. The apparatus of claim 1, wherein the first portion of the outer surface of the housing covers approximately 50%-70% of the first portion of the inner surface.

4. The apparatus of claim 1, wherein the metal element to receive contact by a conductive element; and wherein the antenna maintains an uninterrupted radio link with a source of a radio signal.

5. The apparatus of claim 1, wherein the capacitive load offsets a capacitance caused by a conductive element contacting the metal element.

6. The apparatus of claim 1, the antenna to operate at an efficiency of at least approximately −5 decibels (dB) in response to contact by a conductive element with at least a portion of the metal element.

7. The apparatus of claim 1, the antenna to maintain at least approximately −6 dB impedance matching in response to contact by a conductive element with at least a portion of the metal element.

8. The apparatus of claim 1, further comprising:

a printed circuit board (PCB) disposed with the housing; and at least one audio speaker component disposed on the PCB, the at least one audio speaker component to produce an audio output corresponding to an RF signal received by the antenna.

9. The apparatus of claim 1, wherein a value of the capacitive load is greater than or equal to 3 picofarads.

10. The apparatus of claim 1, the antenna comprises a loop antenna structure having a first end coupled to a PCB ground and a second end coupled to an RF feed, wherein the first portion of the outer surface of the housing covers at least a distal point away from the PCB ground and the RF feed and extends to cover 50%-70% of an area of the loop antenna.

11. An apparatus comprising:

a housing comprising an inner surface and an outer surface;

a printed circuit board (PCB) disposed within the housing;

an antenna disposed on a first portion of the inner surface of the housing, the antenna to receive a radio signal from a source device, the antenna comprising:

a first segment extending from a first end coupled to a radio frequency (RF) feed in a first direction to a second end, the RF feed to transmit a signal corresponding to the radio signal to the PCB;

a second segment extending from the second end of the first segment in a second direction perpendicular to the first direction; and a third segment extending from a distal end of the second segment in the first direction, the third segment comprising an open end corresponding to a high impedance region of the antenna; and a metal element disposed on a first portion of the outer surface of the housing, the first portion of the outer surface covering the open end of the third segment of the antenna, wherein the metal element applies a first capacitive load to the antenna structure to resist detuning of the antenna structure in response to contact by a conductive element with the housing in the high impedance region of the antenna.

12. The apparatus of claim 11, wherein the capacitive load offsets a capacitance caused by a conductive element contacting the metal element.

13. The apparatus of claim 11, wherein the radio signal is in a frequency range of between approximately 2400-2485 MHz.

14. The apparatus of claim 11, the antenna to maintain reception of the radio signal while a conductive element contacts the metal element.

15. The apparatus of claim 11, the antenna to operate at an efficiency of at least approximately −5 decibels (dB) while a conductive element contacts at least a portion of the metal element.

16. The apparatus of claim 11, the antenna to maintain at least approximately −6 dB impedance matching in response to contact by a conductive element with at least a portion of the metal element.

17. The apparatus of claim 11, wherein the metal element covers approximately 50%-70% of a surface area of the antenna.

18. The apparatus of claim 11, wherein the antenna comprises a folded monopole antenna structure.

19. The apparatus of claim 11, further comprising an audio speaker component disposed on the PCB.

20. The apparatus of claim 11, further comprising a touch electrode disposed on the outer surface of the housing in proximity to the antenna.

* * * * *